US009822636B2

(12) United States Patent
Chu

(10) Patent No.: US 9,822,636 B2
(45) Date of Patent: Nov. 21, 2017

(54) DOWNHOLE TELEMETRY SYSTEMS WITH VOICE COIL ACTUATOR

(71) Applicant: Halliburton Energy Services, Inc., Houston, TX (US)

(72) Inventor: Jianying Chu, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/904,620

(22) PCT Filed: Oct. 31, 2013

(86) PCT No.: PCT/US2013/067730

§ 371 (c)(1),
(2) Date: Jan. 12, 2016

(87) PCT Pub. No.: WO2015/065419

PCT Pub. Date: May 7, 2015

(65) Prior Publication Data

US 2016/0146001 A1 May 26, 2016

(51) Int. Cl.
*E21B 47/18* (2012.01)

(52) U.S. Cl.
CPC ..... *E21B 47/18* (2013.01)

(58) Field of Classification Search
CPC ..... E21B 47/18; E21B 47/12; E21B 47/14; E21B 47/182; E21B 47/185; E21B 47/187
See application file for complete search history.

(56) References Cited

U.S. PATENT DOCUMENTS

| | | | | |
|---|---|---|---|---|
| 9,090,315 | B1 * | 7/2015 | Stone | G02B 6/3604 |
| 9,617,850 | B2 * | 4/2017 | Fripp | E21B 47/18 |
| 2002/0039328 | A1 * | 4/2002 | Dubinsky | E21B 47/16 367/82 |
| 2004/0069530 | A1 * | 4/2004 | Prain | E21B 47/185 175/40 |
| 2011/0056750 | A1 * | 3/2011 | Lucon | E21B 7/24 175/56 |
| 2011/0122727 | A1 | 5/2011 | Gleitman et al. | |
| 2011/0139445 | A1 * | 6/2011 | Fripp | E21B 47/12 166/250.15 |
| 2012/0051183 | A1 * | 3/2012 | Roussel | G01S 7/52004 367/89 |
| 2012/0132416 | A1 | 5/2012 | Zolezzi-Garreton | |
| 2013/0037259 | A1 | 2/2013 | Cavender et al. | |

(Continued)

FOREIGN PATENT DOCUMENTS

| | | | |
|---|---|---|---|
| EA | 008325 | B1 | 4/2007 |
| RU | 2114304 | C1 | 6/1998 |

(Continued)

*Primary Examiner* — Hirdepal Singh
(74) *Attorney, Agent, or Firm* — Chamberlain Hrdlicka

(57) ABSTRACT

Pulse telemetry systems and methods for communicating digital data from a wellbore to a surface unit are presented that include a valve fluidly coupled to drilling fluid. The valve adjusts pressure in a drillpipe to cause pressure transitions within the drilling fluid within the drillpipe to transmit data over the drilling fluid. The valve includes a voice coil actuator for developing the pressure transitions within the drilling fluid. Other systems and methods and are included.

17 Claims, 6 Drawing Sheets

(56) References Cited

U.S. PATENT DOCUMENTS

| | | | | |
|---|---|---|---|---|
| 2013/0076527 | A1* | 3/2013 | Sitka | E21B 47/06 340/854.4 |
| 2013/0104642 | A1* | 5/2013 | Pelletier | E21B 49/10 73/152.47 |
| 2014/0124693 | A1* | 5/2014 | Gopalan | E21B 47/182 251/359 |
| 2014/0286129 | A1* | 9/2014 | Longfield | E21B 47/14 367/33 |
| 2015/0129230 | A1* | 5/2015 | Carlson | E21B 43/00 166/308.1 |
| 2015/0360381 | A1* | 12/2015 | Tomlinson | B26D 5/007 83/76.8 |
| 2016/0138391 | A1* | 5/2016 | Logan | E21B 4/14 367/85 |
| 2017/0167252 | A1* | 6/2017 | Pratt | E21B 47/18 |

FOREIGN PATENT DOCUMENTS

| | | | |
|---|---|---|---|
| RU | 2208154 | C1 | 10/2003 |
| RU | 2256794 | C1 | 7/2005 |
| SU | 126526 | A1 | 1/1960 |
| WO | 2012141880 | A2 | 10/2012 |

* cited by examiner

DOWNHOLE TELEMETRY SYSTEMS WITH VOICE COIL ACTUATOR

FIELD

The present disclosure relates generally to oilfield drilling and production, and more particularly, but not by way of limitation, to systems and methods for communicating information from downhole to the surface using pulse telemetry that includes one or more voice-coil actuators.

BACKGROUND

Drilling and production operations are improved with greater quantities of information relating to the conditions and drilling parameters downhole. The information is at times obtained by removing the drilling assembly and inserting a wireline logging tool. With great frequency today, information is obtained while drilling with measurement while drilling (MWD) or logging while drilling (LWD) techniques. Often while drilling, operators would like to know the direction and inclination of the drill bit, temperature and pressure of the wellbore, etc. To accomplish this, sensors or detectors are used downhole. Yet, one challenge is to get the information—or at least a portion of it—to the surface during operations.

To this end, a number of techniques have been developed. For example, in pulse telemetry, acoustic pressure signals are created and sent through the drilling fluid. Still, issues and shortcoming exist with this and similar techniques.

DETAILED DESCRIPTION OF ILLUSTRATIVE EMBODIMENTS

Figure 1:
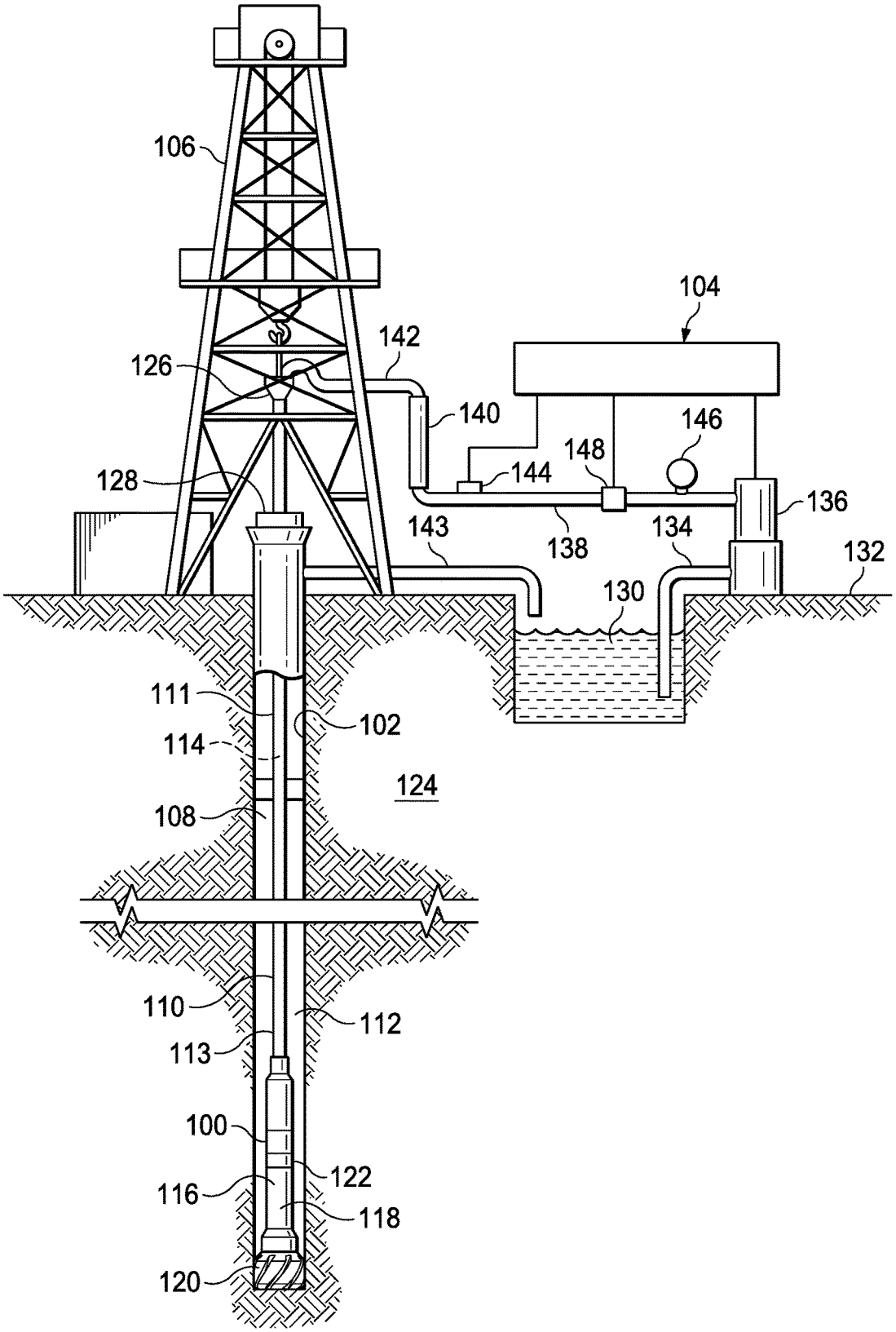
FIG. 1 is a schematic, elevational view with a portion of a formation shown in cross-section showing a pulse telemetry system for communicating digital data from a wellbore to a surface unit.

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is not to be taken in a limiting sense, and the scope of the illustrative embodiments is defined only by the appended claims.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Unless otherwise indicated, as used throughout this document, "or" does not require mutual exclusivity.

As used herein, the terms "seal", "sealing", "sealing engagement" or "hydraulic seal" are intended to include a "perfect seal", and an "imperfect seal. A "perfect seal" may refer to a flow restriction (seal) that prevents all fluid flow across or through the flow restriction and forces all fluid to be redirected or stopped. An "imperfect seal" may refer to a flow restriction (seal) that substantially prevents fluid flow across or through the flow restriction and forces a substantial portion of the fluid to be redirected or stopped.

Referring now to the drawings, FIG. 1 is a schematic, elevational view with a portion of a formation shown in cross-section showing a pulse telemetry system 100 for communicating digital data from a wellbore 102 to a surface unit 104. A derrick 106 is positioned over the well 108 with its wellbore 102. A drillpipe 110 is disposed within the wellbore 102. The drillpipe 110 has a downstream portion 111 and an upstream portion 113. "Upstream" means a further upstream or further against the basic direction of fluid flow from wellbore toward the surface in the pipe under normal circumstances, and "downstream" means further in the same direction as the fluid flow under normal circumstances. The space between the wellbore 102 and an exterior of the drillpipe 110 defines an annulus 112.

The drillpipe 110 includes a central passageway 114 that defines an interior portion of the drillpipe 110. A subassembly 116, which includes a drill collar 118, is coupled to a drill bit 120 and is coupled to or includes the drillpipe 110. The subassembly 116 includes one or more logging tools, detectors, or sensors 122 for developing information about the formation 124 or the drilling process. The one or more sensors 122 includes one or more of the following: gamma ray sensor, azimuthal sensor, borehole pressure sensor, temperature sensor, vibration sensor, shock sensor, torque sensor, porosity sensor, density sensor, resistivity sensor, etc.

Also disposed downhole and associated with the drillpipe 110 is the pulse telemetry system 100. The pulse telemetry system 100 may formed as part of or couple to the subassembly 116. The pulse telemetry system 100 uses one or more valves that include voice coil actuators to modulate the flow of drilling fluid, or mud, in a portion of the drillpipe 110 to generate pulses that travel through or are carried on the drilling fluid to the surface unit 104 where they are further processed. The pulse telemetry system 100 may be a negative pressure telemetry system or could be a positive pressure system. In the negative pressure telemetry system, the valves are momentarily opened outside of the drillpipe 110 to create a quick pressure drop, or negative pressure, pulse that propagates through the drilling fluid to the surface unit 104. In a positive system, the valve or valves restrict the flow of drilling fluid for a brief moment to build a pressure pulse that again propagates through the drilling fluid to the surface unit 104.

As will be explained further below, the pulse telemetry system 100 uses a voice coil actuator to move one or more valve components, e.g., a plunger, to either restrict flow or vent flow to cause pressure pulses for telemetry. The voice coil actuator is believed to be an improvement over designs that use solenoids. As contemplated here, the voice coil actuators may provide a strong electrical-to-mechanical energy conversion efficiency, strong force-to size ratio, quick response times—potentially allowing larger data transmission rates, lighter components, longer service life, minimal maintenance, and avoiding of off-centering effects. The voice coil actuators are named from use of the technology in sound speakers. The voice coil actuator will be further described elsewhere.

The drillpipe 110 may extend downwardly from an elevator assembly 126, which is suspended from the derrick 106, through a rotary table 128. The rotary table 128 causes the drillpipe 110 to rotate and the drill collar and ultimately the drill bit 120 to rotate. Drilling fluid is circulated to the drill bit 120 to assist with the drilling. For example, the drilling fluid may cool the drill bit 120 and remove cuttings.

A tank 130 stores the drilling fluid at the surface 132. A pipe 134 may be used to move the drilling fluid from the tank 130 through a drilling-fluid pump 136 into a pipe 138 that leads to standpipe 140. The standpipe 140 is coupled to the drillpipe 110 by a flexible conduit 142. The drilling-fluid pump 136 pulls drilling fluid from the tank 130 and moves the drilling fluid along the pipes/conduits 138, 140, 142 and into the central passageway 114 of the drillpipe 110 to the subassembly 116. The drilling fluid passing through the subassembly 116 exits proximate to the drill bit 120 and returns to the surface through the annulus 112 and is delivered through pipe 143 to the tank 130. The drilling fluid in tank 130 may be reconditioned (cuttings removed and degassed etc.) and reused. It should be noted that tank 130 may comprise two tanks—one with ready-to-use drilling fluid coupled to pipe 134 and one for receiving used drilling fluid from pipe 143.

The surface unit 104 may, amongst other things, decode pressure pulses, or transitions, sent over the drilling fluid in the central passageway 114. The surface unit 104 may include one or more surface sensors or transducers 144. For example, an array of sensors 144 might be spaced for noise cancellation. The transducer 144 is shown on pipe 138 for sensing the pressure transitions, or pulses, from the pulse telemetry system 100. Other components such as sensors to assist with noise cancellation or a desurger 146 (to minimize surges from pump 136) or other devices may be included. A valve 148 may be included on pipe 138 to induce pulses via the drilling fluid in central passageway 114 to deliver data or instructions from the surface 132 to subassembly 116. The valve 148 may include a voice coil actuator and may function analogous to the valve in the subassembly 116 described further below. In such an embodiment, a decoder may be included in the subassembly for receiving data or commands through pulses initiated by the valve 148. The pulses traveling downward may be used to control aspects of the subassembly 116.

The surface unit 104 may include one or more processors, e.g., microprocessors, associated with one or more memories, drive and control circuitry for downlink communication and detection circuit for uplink communications. The one or more processors and one or more memories are operable to carry out steps including receiving the pressure transitions or pulses, which have been acquired by detection circuit, and decoding them into data in formats desired in an uplink mode. In the downlink mode, the one or more processors and one or more memories are able to encode the data and transmit the encoded data to a downhole device via the drive and control circuit.

Figure 2:
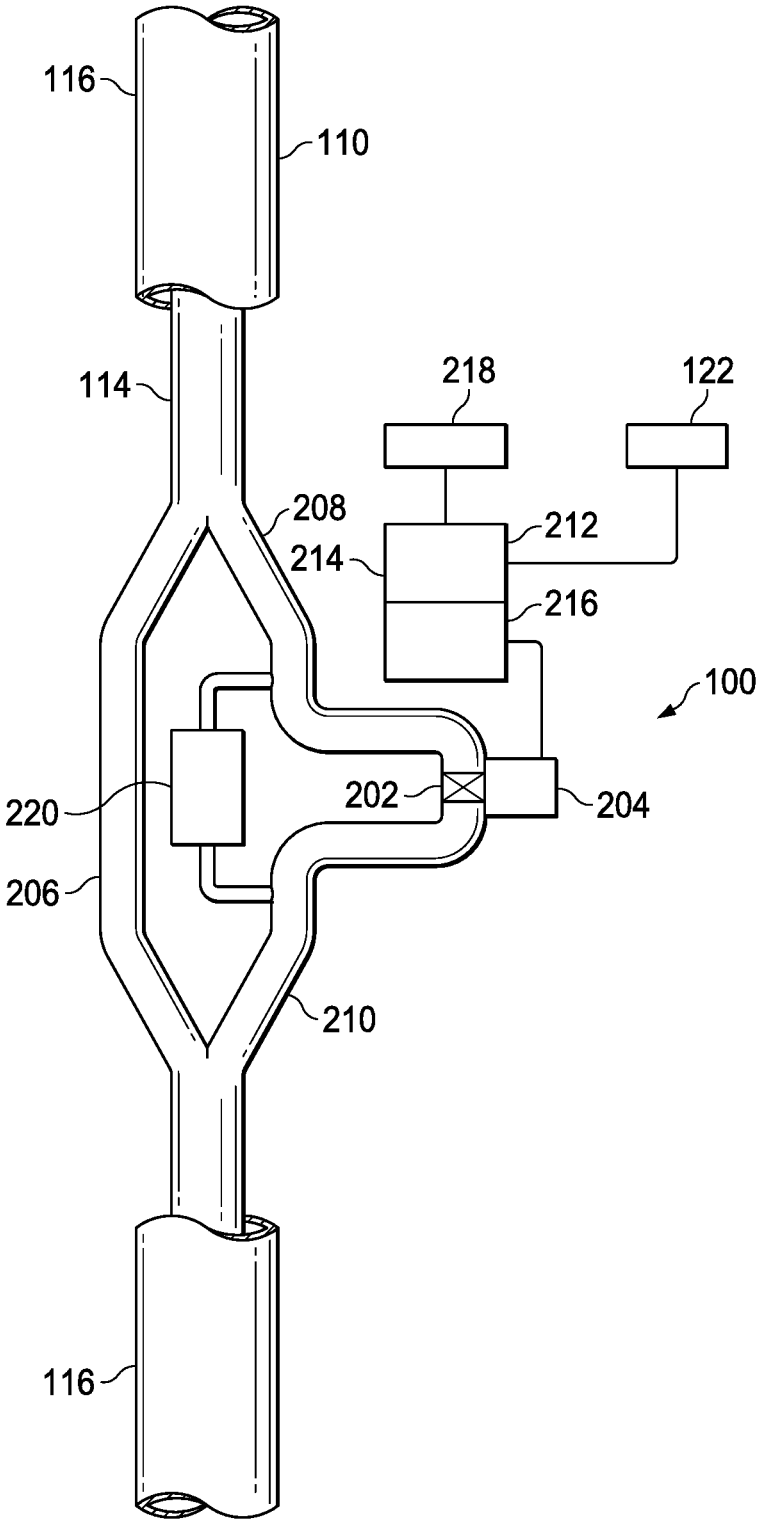
FIG. 2 is a elevational, schematic diagram of an illustrative embodiment of a pulse telemetry system.

Referring now primarily to FIG. 2, a schematic diagram of an illustrative embodiment of a pulse telemetry system 100 is presented. The pulse telemetry system 100 includes a valve 202 that includes a voice coil actuator 204. The valve 202 may be any type that restricts or opens the flow of the drilling fluid as result of movement of one or more components by the voice coil actuator 204. For example, the valve 202 may include a plunger or piston (not explicitly shown) that is moved by a portion of the voice coil actuator 204.

The central passageway 114 of the drillpipe 110 continues into the subassembly 116 and splits into at least two passageways: a bypass passageway 206 and an input passageway 208. An outlet passageway 210 delivers drilling fluid from the valve 202 toward the drill bit 120 (FIG. 1). The drilling fluid in the outlet passageway 210 is united with the drilling fluid from bypass passageway 206. In other embodiments, the bypass passageway 206 may be omitted. For example, in a completely restricted positive valve, the bypass passageway 206 may be omitted. In a negative valve arrangement, the outlet passageway may penetrate the collar of the subassembly 116 into the annulus to divert a portion of the drilling fluid.

A processing unit 212 is associated with the voice coil actuator 204. The processing unit 212 is coupled to the one or more sensors 122 for receiving data therefrom. The processing unit 212 may include one or more processors and one or more memories associated with the one or more processors. The one or more processors and one or more memories are shown generally by numeral 214. A control unit 216 is associated with the one or more processors and one or more memories 214 and the voice coil actuator 204. The control unit 216 will be described more in connection with FIGS. 5 and 6 below.

A power unit 218 may be included to provide power to the one or more processors and one or more memories 214, control unit 216, or voice coil actuator 204. The power unit 218 may be a generator, battery, or other device. A differential pressure transducer 220 may be included to measure pressure of the drilling fluid across the valve 202. Thus, the differential pressure transducer 220 may measure pressure at the inlet passageway 208 and the outlet passageway 210. The resultant pressure differential may be delivered to the one or more processors and one or more memories 214 or the control unit 216.

Figure 3:
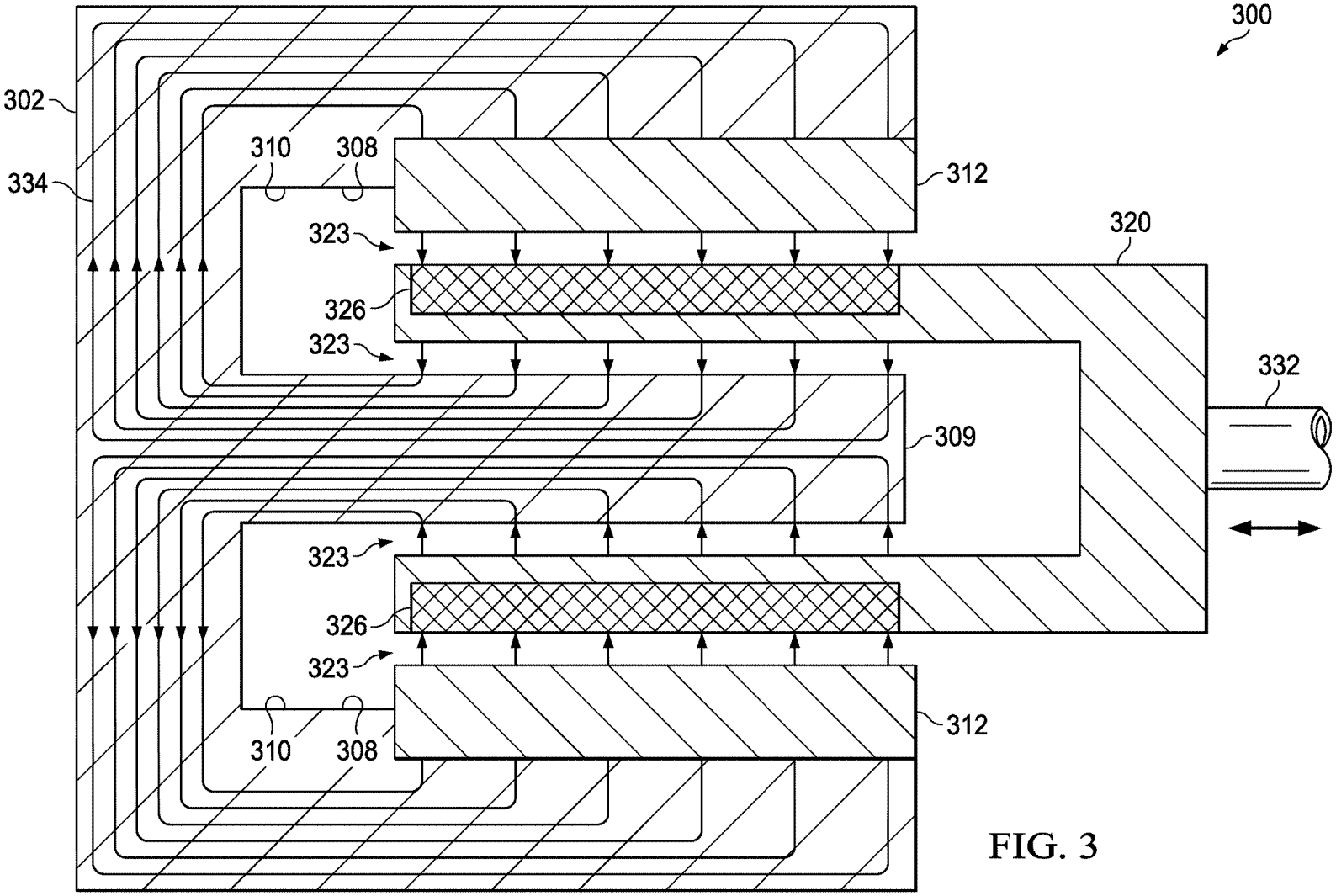
FIG. 3 is a schematic diagram of an illustrative, non-limiting embodiment of a voice coil actuator.

While one illustrative valve arrangement is shown in FIG. 3, it should be understood that numerous valve designs might be used. Yet, all the valve designs include a voice coil actuator.

Referring now primarily to FIG. 3, a schematic diagram of an illustrative, non-limiting embodiment of a voice coil actuator 300 suitable for use as the voice coil actuator 204 in FIG. 2 to manipulate the valve 202 is presented. FIG. 3 is a simplified diagram to present the main concepts, and those skilled in the art will understand that other arrangements are possible. More particularly, FIG. 3 is a sectional view of one cylindrical voice coil actuator 300 along its axis and with a portion removed. The voice coil actuator 300 includes a shell 302, which may be formed from a soft-magnetic material, and which is an E-type cylindrical member. The shell 302 forms an "E" or "EP" shape with members: an outer member 308, which is typically cylindrical in shape, and a center-post member 309. The voice coil actuator 300 also includes a permanent magnet 312 that is coupled to at least a portion of an interior portion or surface 310 of the outer member 308. The center-post member 309 may be coupled with a permanent magnet paired to the magnet 312. A coil 326 is cylindrically wrapped around a coil holder 320 to carry the current. The coil 326 and coil holder 320 form the armature of the actuator in a one embodiment, although permanent magnet 312 and shell 302 may also form the armature. Either way, a small air gap 323 is formed between permanent magnet and coil holder 320. The air gap 323 may be filled with oil or other lubricant for cooling and lubrication purpose.

The coil holder 320 may be made of numerous materials including, without limitation, aluminum alloy, titanium, steel, ceramic, composite materials, etc. A plunger-connect linkage or other linkage 332 may be used to couple the coil holder 320 to one or more components of the valve 202 (FIG. 2) to manipulate flow or pressure through the valve 202. The magnetic field is shown by lines 334. The direction of flow of current in the coils 326, i.e., coil current, influences the direction of the force on linkage 332.

The voice coil actuator 300 develops an electromagnetic force delivered to linkage 332. The force in the present system is used to move one or more components of the valve 202 to create negative or positive pressure transitions, or pulses. While not being limited by theory, the voice coil actuator 300 uses a macroscopic form of Lorentz Force, namely, a magnetic force acting on a current-carrying conductor. The voice coil actuator 300 typically includes the one or more permanent magnets 312 that generate the magnetic field, the magnetic shell 302, e.g., soft magnetic shell, for producing a magnetic field with low reluctance, one or more coils 326 for current flow that interacts with the magnetic field, and the coil holder 320, which not only provides physical support to the coil 326 but also functions as an armature to transfer mechanical force to linkage 332.

The force developed by the voice coil actuator 300 may be approximated with the following equation:

$$F=N*B*I*l \quad (1)$$

Where:

l is an average circular length of the coil(s);

B is a magnetic flux density;

I is a current of the coil(s);

N is the number of turns of the coil(s); and

F is the mechanical force applied to the linkage 332.

The permanent magnet arrangement 312 can generate a substantially uniform magnetic field in the air gap 323 where the coil 326 and coil holder 320 move in an axial direction. According to the Lorentz Force law, the force acting on the coil is shown by equation (1) above.

The voice coil actuator force, F, has a relatively simple relation as shown in equation (1). If one ignores the effect of coil current on the permanent magnet 312, the voice coil actuator force is a linear function of coil current. Moreover, the direction of the force also depends on the direction of the current. These characteristics may make the voice coil actuator 300 a highly controllable device.

The voice coil actuator 300 has good power conversion efficiency compared to many other devices. There is only a little change in the magnetic flux density due to coil current effect, which may weaken or strengthen the magnetic field depending on the direction of coil current. This means insignificant magnetic hysteresis loss. Since the flux density change is very little, the induced eddy current loss is also much less compared to other approaches.

Additionally, there is no magnetic stored energy loss. In addition, higher power efficiency leads to lower system temperature rise, which in turn helps the magnets minimize parametric drift.

The voice coil actuator 300 has a good force-to-size ratio. When the coil 326 moves in the air gap, the air gap does not change, and accordingly a minimal air gap is achievable. For a given magnet, a stronger magnetic field can be generated than with solenoids or other techniques. By sophisticated flux-focus design, the flux density in the air gap can be even higher than the residual value for the magnets 326. Producing a stronger magnetic field produces a better force-to-current ratio. The voice coil actuator's mechanical force has little relation to the position of coil. During one stroke of the coil, the mechanical force will remain substantially constant if the coil current does not change.

The voice coil actuator 300 also has a quick response time. This allows for enhanced data transmission rates. Indeed, the response time can be less than one millisecond. In contrast to other devices that generate the mechanical force by storing the magnetic energy in the air gap which is normally slow due to the high inductor-resistor (LR) time constant of coil, the voice coil actuator 300 is considerable quicker. The voice coil actuator 300 generates its mechanical force without energy storage but rather relies on the coil current interacting with permanent magnetic field. Again, the pulse telemetry systems herein carry more data than other systems, e.g., solenoid actuated systems, because the pulse rate can be considerably quicker.

The voice coil actuator 300 can cycle at 10 Hz or more.

The voice coil actuator 300 may have a light moving armature, which is formed by the coil 326 and the coil holder 320. Since there is not any magnetic field passing through the armature, a wide variety of light materials are available for use. Lighter armature material results in lower system inertia, and consequentially, a lower force requirement. The voice coil actuator 300 may also avoid off-centering effects that some other devices can encounter.

Figure 4:
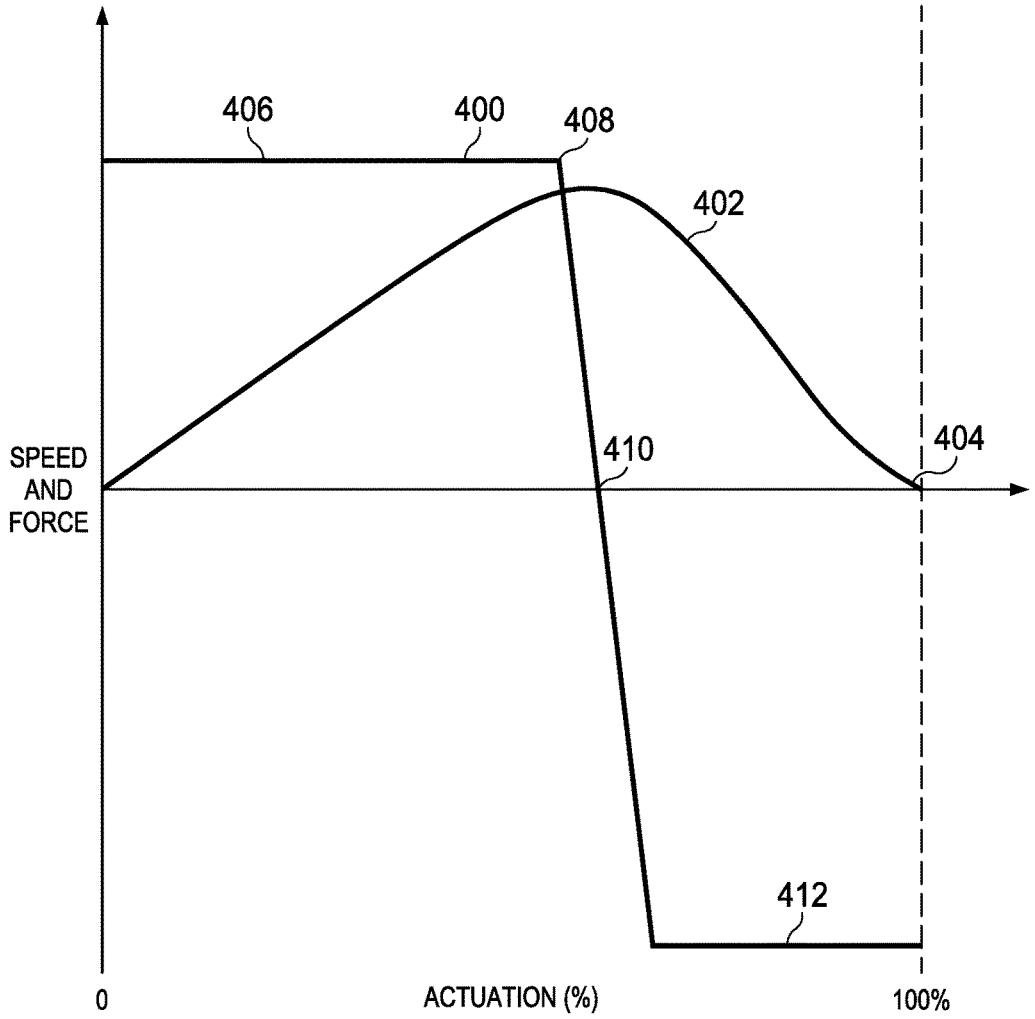
FIG. 4 is a schematic plot for two curves under ideal conditions (resistance not included)

Referring now primarily to FIG. 4, a schematic plot is presented for two curves under ideal conditions (resistance not included). One curve 400 shows the force developed by the voice coil actuator. In this instance, the ordinate qualitatively presents force and the abscissa presents percentage actuation of a valve actuated by the voice coil actuator.

The second curve 402 presents the speed of the linkage or moving component in the valve. The speed is shown qualitatively on the ordinate axis. The plot shows the ideal shaft speed in relation to the shaft position (actuation) as well as the required net force acting on the shaft in one illustrative valve.

In the embodiment of FIG. 4, there is no mechanical impact on the shaft since the speed reduces to zero proximate point 404 when fully actuated. So the valve will be free from wear-out or damage of the type encountered on solenoid valves. The force is initially positive and fairly constant on segment 406, and then is decreased at 408 and goes negative starting proximate to 410. The force becomes a fairly constant negative at segment 412. The coil actuator can achieve this change in force direction easily since the direction of the mechanical force depends on the direction of magnetic field and also the coil current.

Figure 5:
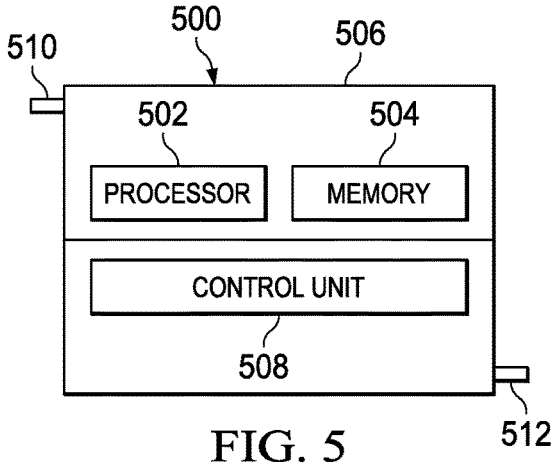
FIG. 5 is a schematic diagram of a processing unit.

Referring now primarily to FIG. 5, a schematic diagram of a processing unit 500 is presented. The processing unit 500 includes one or more processors 502 associated with one or more memories 504 to form a processing member 506. The processing unit 500 also includes a control unit 508. The processing member 506 is coupled to one or more downhole sensors and may receive data from the one or more downhole sensors through an input 510 bus. The one or more processors 502 and the one or more memories 504 are configured to perform numerous processes. For example, the one or more processors 502 and more memories 504 may be configured or programmed to carry out functions such as converting some or all the data from the sensors received through input 510 into binary data that is desirable for use on the surface. The binary data may be delivered to the control unit 508 and the control unit may control the voice coil actuator by signals delivered from output 512. The control unit 508 develops the necessary movements of the voice coil actuator to actuate the valve, e.g., valve 202 in FIG. 2, to transmit pressure transitions to or at least toward the surface carrying the data.

Figure 6:
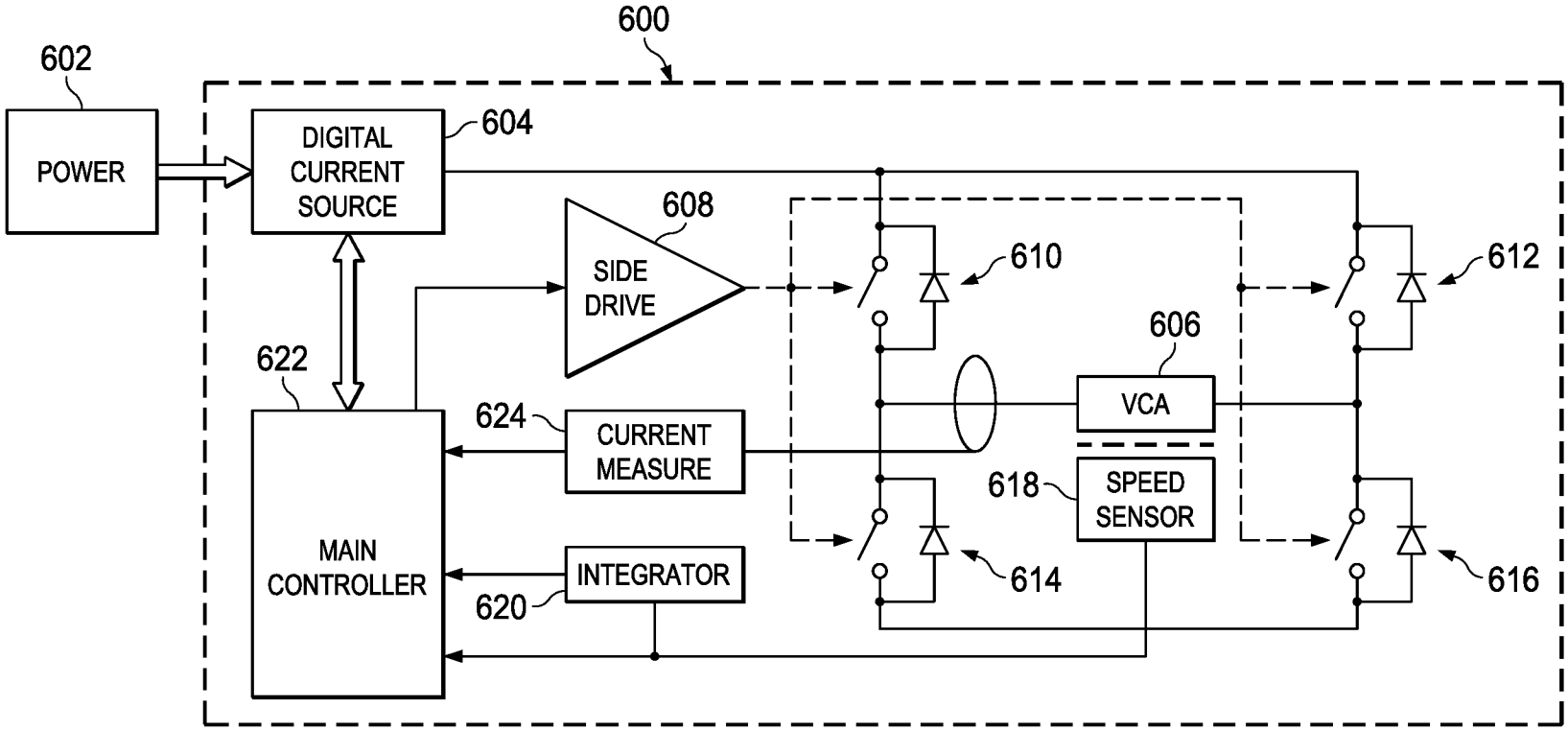
FIG. 6 is a schematic circuit diagram of an illustrative embodiment of a control unit 600.

Referring now primarily to FIG. 6, a schematic circuit diagram of an illustrative embodiment of a control unit 600 is shown. A power unit 602 provides power to the control unit 600. The power unit 602 may be a downhole generator, a battery, or other device. The power is delivered to a digital current source or controller 604. The digital current source 604 typically changes the current from high to low and controls the amount of current that is ultimately delivered to the voice coil actuator 606. The force developed by the voice coil actuator 606 is proportional to the current and so by controlling the amount of current, the developed force may be controlled. Any type of controller for the current may be used.

The voice coil actuator 606 may apply a force in two directions depending on which way the current is applied. An aspect of the control unit 600 is able to change the direction of the current flow. In this illustrative, non-limiting embodiment, a side drive 608 and main controller 622 control the direction of current flowing through the voice coil actuator 606. The side drive 608 is used with a plurality of unidirectional switches 610, 612, 614, and 616. The switches 610, 612, 614, and 616 may comprise one or more the following: transistors, MOSFET, IGBT, or other switching devices. By controlling the switches, the flow of current through the voice coil actuator 606 may assume either of two directions. For example, there is one current flow generated by closing the switches 610, 616 and opening the switches 612,614; the opposite current is generated by closing the switches 612, 614 and opening the switches 610,616.

The voice coil actuator 606 uses a force direction change to minimize the final mechanical impact in the valves and the control unit 600 is used to assist with this purpose. The force developed by the voice coil actuator 606 depends on the magnetic field and coil current. The direction change of a force can rise from the field direction change or current direction change. Considering the rather short shaft stroke e.g., about 0.156 inches in one illustrative embodiment, it is difficult to change the direction of the magnetic field quickly enough. Even if it were achieved, the magnetic hysteresis loss and eddy current loss would increase dramatically due to a large flux change. For this reason, the main illustrative embodiment presented changes the direction of the current, which in turn can be implemented by either the current source or circuit switch structure. The latter is presented in FIG. 6.

As previously referenced, FIG. 6 presents a full bridge drive that can change the current direction quickly. A question is when to change the direction of the current. To answer this question, one may consider information about the shaft movement, position and speed. Accordingly, a proper proportional-integral-derivative (PID) controller can be implemented to accurately control the actuation. However, such accuracy may not be necessary since the small speed of the shaft or linkage at the end of stroke will not cause serious impact. In some embodiments, including FIG. 5, to simplify the system design, only a speed sensor 618 may be used for control. The position of the shaft or linkage can later be deduced by either an external integrator 620 or internal digital processing in a main controller 622.

The main controller 622 may provide control to the digital current source 604 to set the amount of current used and to control the side drive 608 to control the direction. The main controller 622 receives speed information from speed sensor 618 to calculate an estimate of the actuator position or may receive displacement information from the integrator 620. In addition, the current proximate the voice coil actuator 606 may be measured by a current sensor 624.

The current measure may form a part of a control loop of a digital current source. In such a case, the main controller 622, digital current source 604 and current measure or sensor 624 are integrated into one complete control loop. The current sensor 624 serves as the feedback of control loop. In another case, the current sensor 624 may ensure the functionality of the digital current source 604 and transistors 610, 612,614 and 616 to achieve better system reliability. The current sensor 624 can be implemented by shunt current resistor, hall current sensor, magnet or resistive sensor or current transformer.

It may be beneficial to include in the control unit 600 a device for determining or approximating the location of the armature or linkage within the voice coil actuator 606. As noted, this may be done directly measuring displacement or alternatively speed may be used to calculate the approximate position. In the present illustrative embodiment, the speed approach is used and the control unit 600 includes the speed sensor 618 for detecting the speed of the voice coil actuator 606 and in particular the armature. The speed information from the speed sensor 618 is provided to the main controller 622 or optionally to the integrator 620. The integration of the speed information to calculate displacement may be done digitally by the main controller 622, or an analog signal may be integrated by the integrator 620. The speed sensor 618 may be contact or contactless. The former may be the resistive potential measure and the latter may be digital encoder, magnetic resolver or even a miniature of VCA or other device.

The displacement is used to determine when to reverse the current and thereby to determine the force direction in the voice coil actuator 606. By controlling the change, the armature or moving components within the valve associated with the voice coil actuator 606 may avoid impact with other surfaces and thereby avoid fatigue or wear. Those skilled in the art will understand that other embodiments of the control unit may be used.

Figure 7:
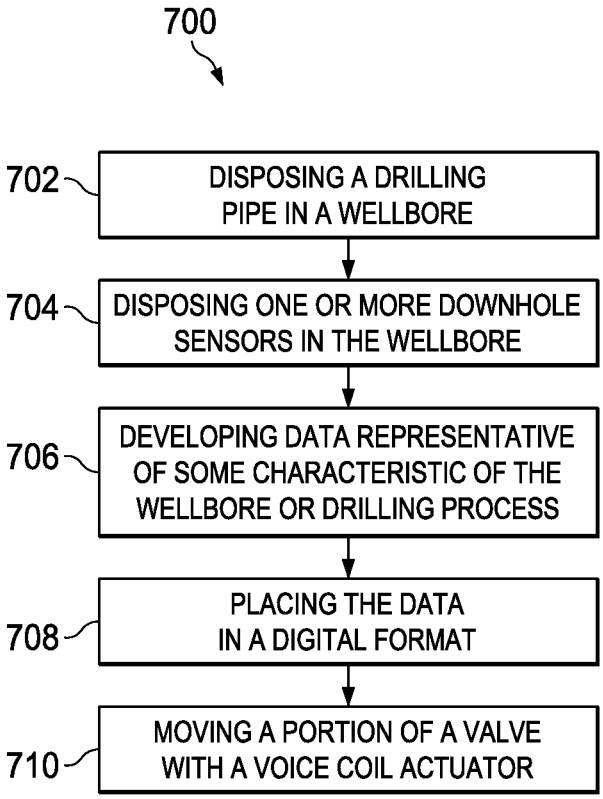
FIG. 7 is a schematic flow diagram of an illustrative embodiment of one method for transmitting data developed in a wellbore to a surface unit.

Referring now primarily to FIG. 7, the figure is a schematic flow diagram of an illustrative embodiment of one method 700 for transmitting data developed in a wellbore to a surface unit. The method 700 includes the step 702 of disposing a drillpipe in a wellbore. At least a portion of the drillpipe includes a drilling fluid that extends in a column to the surface unit. The method 700 also includes the step 704 of disposing one or more downhole sensors in the wellbore and the step 706 of using the one or more downhole sensors to develop data representative of some characteristic of the wellbore or drilling process. The method 700 also involves the step 708 of placing the data in a digital format to arrive at a digital data set and the step 710 of moving a portion of a valve with a voice coil actuator in response to a control signal to develop pressure transitions in the drilling fluid that carry the digital data set over the drilling fluid to the surface unit. Other methods will be apparent from the description herein.

In addition to the embodiments described above, many examples of specific combinations are within the scope of the disclosure, some of which are detailed below.

Example 1. A pulse telemetry system for communicating digital data from a wellbore to a surface unit that includes: a drillpipe positioned downhole having an upstream end and containing, at least in portion, a drilling fluid; one or more downhole sensors; a processing unit coupled to the one or more downhole sensors; a valve fluidly coupled to the drilling fluid for adjusting pressure in the drillpipe proximate the upstream end to cause pressure transitions within the drilling fluid within the drillpipe to transmit data over the drilling fluid; and wherein the valve includes a voice coil actuator for developing the pressure transitions within the drilling fluid.

Example 2. The pulse telemetry system of example 1 above, wherein the processing unit includes at least one processor and at least one memory associated with the processor, whereby the at least one processor and at least one memory are operable to perform the following steps: receiving data from the one or more sensors; developing a digital representation of at least some of the data; and sending a control signal to the voice coil actuator that modulates pressure transitions in the drilling fluid in accord with the digital data.

Example 3. The pulse telemetry system of example 1 above or example 2, wherein the voice coil actuator includes a coil holder coupled to a valve plunger for creating a seal within the valve. The coil holder may be made of aluminum, titanium, or other material.

Example 4. The pulse telemetry system of example 1 above or examples 2 or 3, wherein the valve is operable to receive a closing force from the voice coil actuator and an opening force from the voice coil actuator within less than one second.

Example 5. The system of example 1 or any of examples 2 or 3, wherein the valve is operable to receive a closing force from the voice coil actuator and an opening force from the voice coil actuator within less than 5 to 10 milliseconds.

Example 6. The system of example 1 or any of the examples 2-5, wherein the voice coil actuator includes: one or more permanent magnets; a shell; a coil holder; a coil associated with at least a portion of the coil holder; and wherein the one or more permanent magnets are stationary and wherein the coil holder is configured to move relative to the one or more permanent magnets and the coil holder is coupled to a portion of the valve for moving a component within the valve.

Example 7. The system of example 1 or any of examples 2-5, wherein the voice coil actuator includes: one or more permanent magnets; a shell; a coil holder; a coil associated with at least a portion of the coil holder; and wherein the coil holder is stationary and the one or more permanent magnets are coupled to a portion of the valve for moving a component within the valve, and the one or more permanent magnets are configured to move relative to the coil holder.

Example 8. The system of example 1 or any of examples 3-7, wherein the processing unit includes a control unit, and wherein the control unit includes: a digital current source for controlling an amount of current delivered to the voice coil actuator; and a main controller and side drive for controlling a direction of current flowing through the voice coil actuator.

Example 9. The system of example 1 or any of the preceding examples, wherein the one or more downhole sensors includes one or more of the following: gamma ray sensor, compass sensor, tool face sensor, borehole pressure sensor, temperature sensor, vibration sensor, shock sensor, torque sensor, porosity sensor, density sensor and resistivity sensor.

Example 10. A method for transmitting data developed in a wellbore to a surface unit including: disposing a drillpipe in a wellbore, wherein at least a portion of the drillpipe includes a drilling fluid that extends in a column to the surface unit; disposing one or more downhole sensors in the wellbore; using the one or more downhole sensors to develop data representative of some characteristic of the wellbore or drilling process; placing at least a portion of the data in a digital format to arrive at a digital data set; and moving a portion of a valve with a voice coil actuator in response to a control signal to develop pressure transitions in the drilling fluid that carry the digital data set over the drilling fluid to the surface unit.

Example 11. The method of example 10, wherein the voice coil actuator includes a coil holder coupled to a valve plunger for creating a seal within a valve.

Example 12. The method of example 10, wherein the valve is operable to receive a closing force from the voice coil actuator and an opening force from the voice coil actuator within less than one second.

Example 13. The method of example 10, wherein the valve is operable to receive a closing force from the voice coil actuator and an opening force from the voice coil actuator within less than 5 to 10 milliseconds.

Example 14. The method of example 10, wherein the voice coil actuator includes: one or more permanent magnets; a shell; a coil holder; a coil associated with at least a portion of the coil holder; wherein the one or more permanent magnets are stationary and wherein the coil holder is configured to move relative to the one or more permanent magnets and is coupled to a portion of the valve for moving a component within the valve; and wherein the step of moving a portion of a valve with a voice coil actuator includes moving the coil holder to move the portion of the valve.

Example 15. The system of example 10, wherein the voice coil actuator includes: one or more permanent magnets; a shell; a coil holder; a coil associated with at least a portion of the coil holder; wherein the coil holder is stationary and the one or more permanent magnets are coupled to a portion of the valve for moving a component within the valve, and the one or more permanent magnets are configured to move relative to the coil holder; and wherein the step of moving a portion of a valve with a voice coil actuator includes moving the one or more permanent magnets to move the portion of the valve.

Example 16. The method of example 10 or any of examples 11-15, wherein the processing unit includes a control unit, and wherein the control unit includes: a digital current source for controlling an amount of current delivered to the voice coil actuator; and a main controller and side drive for controlling a direction of current flowing through the voice coil actuator.

Example 17. The method of example 10 or any of examples 11-16, wherein the step of disposing one or more downhole sensors in the wellbore includes disposing one or more of the following: gamma ray sensor, compass sensor, tool face sensor, borehole pressure sensor, temperature sensor, vibration sensor, shock sensor, torque sensor, porosity sensor, density sensor, and resistivity sensor.

Example 18. A method of manufacturing a downhole pulse telemetry unit, wherein the method includes: forming a valve to be associated with a drillpipe for creating pressure transitions with a drilling fluid; and coupling a voice coil actuator to the valve for moving at least a portion of the valve.

Example 19. The method of example 18, further including electrically coupling a processing unit to the voice coil actuator.

Example 20. The method of example 18, wherein the voice coil actuator includes a coil holder coupled to a valve plunger for creating a seal within the valve.

Although the present invention and its advantages have been disclosed in the context of certain illustrative, non-limiting embodiments, it should be understood that various changes, substitutions, permutations, and alterations can be made without departing from the scope of the invention as defined by the appended claims. It will be appreciated that any feature that is described in connection to any one embodiment may also be applicable to any other embodiment.

It will be understood that the benefits and advantages described above may relate to one embodiment or may relate to several embodiments. It will further be understood that reference to "an" item refers to one or more of those items.

The steps of the methods described herein may be carried out in any suitable order, or simultaneously where appropriate.

Where appropriate, aspects of any of the examples described above may be combined with aspects of any of the other examples described to form further examples having comparable or different properties and addressing the same or different problems.

It will be understood that the above description of preferred embodiments is given by way of example only and that various modifications may be made by those skilled in the art. The above specification, examples and data provide a complete description of the structure and use of exemplary embodiments of the invention. Although various embodiments of the invention have been described above with a certain degree of particularity, or with reference to one or more individual embodiments, those skilled in the art could make numerous alterations to the disclosed embodiments without departing from the scope of the claims.

I claim:

1. A pulse telemetry system for communicating digital data from a wellbore to a surface unit, the system comprising:

a drillpipe positioned downhole having an upstream end and containing, at least in portion, a drilling fluid;

one or more downhole sensors;

a processing unit coupled to the one or more downhole sensors;

a valve fluidly coupled to the drilling fluid to adjust pressure in the drillpipe proximate the upstream end to cause pressure transitions within the drilling fluid to transmit data via the drilling fluid;

wherein the valve includes a voice coil actuator for developing the pressure transitions within the drilling fluid; and wherein the processing unit comprises a speed sensor operable to measure the speed of the voice coil actuator, and the processing unit is operable to control the position of the voice coil actuator based on the measured speed.

2. The system of claim 1, wherein the processing unit includes at least one processor and at least one memory associated with the processor, whereby the at least one processor and at least one memory are operable to perform the following steps:

receiving data from the one or more sensors;

developing a digital representation of at least some of the data; and sending a control signal to the voice coil actuator that modulates pressure transitions in the drilling fluid in accord with the digital data.

3. The system of claim 1, wherein the voice coil actuator comprises a coil holder coupled to a valve plunger to create a seal within the valve.

4. The system of claim 1, wherein the voice coil actuator is configured to deliver a closing force to a portion of the valve and an opening force to a portion of the valve within less than one second.

5. The system of claim 1, wherein the voice coil actuator is configured to deliver a closing force to a portion of the valve and an opening force to a portion of the valve within less than 0.3 seconds.

6. The system of claim 1, wherein the voice coil actuator comprises:

one or more permanent magnets;

a shell;

a coil holder;

a coil associated with at least a portion of the coil holder; and wherein the one or more permanent magnets are stationary and wherein the coil holder is configured to move relative to the one or more permanent magnets and the coil holder is coupled to a portion of the valve to move a component within the valve.

7. The system of claim 1, wherein the voice coil actuator comprises:

one or more permanent magnet;

a shell;

a coil holder;

a coil associated with at least a portion of the coil holder; and wherein the coil holder is stationary and the one or more permanent magnets are coupled to a portion of the valve to move a component within the valve, and the one or more permanent magnets are configured to move relative to the coil holder.

8. The system of claim 1, wherein the processing unit comprises a control unit, and wherein the control unit comprises:

a digital current source configured to control an amount of current delivered to the voice coil actuator; and a main controller and a side drive to control a direction of current flowing through the voice coil actuator.

9. The system of claim 1, wherein the one or more downhole sensors comprises one or more of the following: gamma ray sensor, compass sensor, tool face sensor, borehole pressure sensor, temperature sensor, vibration sensor, shock sensor, and torque sensor, porosity sensor, density sensor, and resistivity sensor.

10. A method for transmitting data developed in a wellbore to a surface unit, the method comprising:

disposing a drillpipe in a wellbore, wherein at least a portion of the drillpipe includes a drilling fluid that extends in a column to the surface unit, disposing one or more downhole sensors in the wellbore, using the one or more downhole sensor to develop data representative of some characteristic of the wellbore or drilling process;

placing at least a portion of the data in a digital format to arrive at a digital data set;

moving a portion of a valve with a voice coil actuator in response to a control signal to develop pressure transitions in the drilling fluid that carry the at least a portion of digital data set over the drilling fluid to the surface unit; and controlling the position of the voice coil actuator based on a measured speed of the voice coil actuator.

11. The method of claim 10, wherein the voice coil actuator comprises a coil holder coupled to a valve plunger to create a seal within a valve.

12. The method of claim 10, wherein the valve receives a closing force from the voice coil actuator and an opening force from the voice coil actuator within less than one second.

13. The method of claim 10, wherein the valve receives a closing force from the voice coil actuator and an opening force from the voice coil actuator within less than 0.3 seconds.

14. The method of claim 10, wherein the voice coil actuator comprises:

one or more permanent magnets;

a shell;

a coil holder;

a coil associated with at least a portion of the coil holder;

wherein the one or more permanent magnets are stationary and wherein the coil holder moves relative to the one or more permanent magnets when the voice coil is actuated;

wherein the coil holder is coupled to a portion of the valve to move a component within the valve; and wherein moving a portion of a valve with a voice coil actuator comprises moving the coil holder to move the portion of the valve.

15. The system of claim 10, wherein the voice coil actuator comprises:

one or more permanent magnets;

a shell;

a coil holder;

a coil associated with at least a portion of the coil holder;

wherein the coil holder is stationary and the one or more permanent magnets are coupled to a portion of the valve to move a component within the valve, and the one or more permanent magnets are configured to move relative to the coil holder; and wherein moving a portion of a valve with a voice coil actuator comprises moving the one or more permanent magnets to move the portion of the valve.

16. The method of claim 10, wherein the processing unit comprises a control unit, and wherein the control unit comprises:

a digital current source to control an amount of current delivered to the voice coil actuator; and a main controller and side drive to control a direction of current flowing through the voice coil actuator.

17. The method of claim 10, wherein the step of disposing one or more downhole sensors in the wellbore comprises disposing one or more of the following: gamma ray sensor, compass sensor, tool face sensor, borehole pressure sensor, temperature sensor, vibration sensor, shock sensor, and torque sensor, porosity sensor, density sensor, and resistivity sensor.

* * * * *